United States Patent [19]

Littlewood

[11] 4,429,133

[45] Jan. 31, 1984

[54] 2'-BENZOTHIAZOLYL-AND 2'-BENZOXAZOLYL-2-BENZIMIDAZOLES

[75] Inventor: Peter S. Littlewood, Menston, England

[73] Assignee: Sandoz Ltd., Basel, Switzerland

[21] Appl. No.: 819,937

[22] Filed: Jul. 28, 1977

[30] Foreign Application Priority Data

Aug. 4, 1976 [GB] United Kingdom ..... 32457/76
Feb. 25, 1977 [GB] United Kingdom ..... 7982/77

[51] Int. Cl.[3] ..... C07D 413/04; C07D 417/04

[52] U.S. Cl. ..... 548/159; 548/217; 548/218; 252/301.27; 252/301.28; 252/301.32

[58] Field of Search ..... 260/307 D, 304 R, 346.22; 548/159, 217, 218

[56] References Cited

U.S. PATENT DOCUMENTS

| | | | |
|---|---|---|---|
| 2,148,920 | 2/1939 | Zerweck et al. | 548/156 |
| 3,653,943 | 4/1972 | Kaempfen | 260/307 D |
| 3,767,663 | 10/1973 | Kaempfen | 260/307 D |
| 3,864,333 | 2/1975 | Sahm et al. | 252/301.27 X |
| 3,900,419 | 8/1975 | Schlapfer et al. | 260/307 D |
| 3,932,446 | 1/1976 | Grychtol | 260/307 D |
| 4,001,138 | 1/1977 | Lohman | 252/301.27 |
| 4,014,871 | 3/1977 | Kormany et al. | 548/131 |
| 4,087,244 | 5/1978 | Greve et al. | 8/41 R |

FOREIGN PATENT DOCUMENTS

| | | | |
|---|---|---|---|
| 578303 | 6/1959 | Canada | 260/307 D |
| 2166632 | 2/1977 | Fed. Rep. of Germany . | |
| 207178 | 2/1937 | Switzerland | 260/307 D |

OTHER PUBLICATIONS

Ennis et al., J. Chem. Soc. "C", pp. 33-39, 1967.
Berndt et al., J. Het. Chem., 9(1), pp. 137-140, (1972).

*Primary Examiner*—Donald G. Daus
*Assistant Examiner*—D. B. Springer
*Attorney, Agent, or Firm*—Gerald D. Sharkin; Richard E. Vila; Thomas C. Doyle

[57] ABSTRACT

Disclosed are compounds of Formula I,

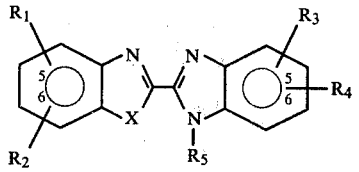

I where either $R_1$, $R_2$, $R_3$ and $R_4$, independently, are hydrogen, $C_{1-4}$alkyl, $C_{1-4}$alkoxy, halogen, cyano, carboxy, alkoxy($C_{1-4}$)carbonyl, —$CONR_6R_7$, —$SO_2NR_6R_7$, —$SO_2R_8$, alkyl($C_{1-4}$)carbonyloxy, or $C_{1-4}$alkoxy monosubstituted by phenyl, alkoxy($C_{1-4}$)carbonyl, cyano, carboxy or —$CONR_6R_7$, with the proviso that a maximum of one of $R_1$ and $R_2$ and a maximum of one of $R_3$ and $R_4$ can signify a group selected from cyano, carboxy, alkyl ($C_{1-4}$)carbonyloxy, —$CONR_6R_7$, —$SO_2NR_6R_7$ and —$SO_2R_8$, or one or both pairs $R_1$ and $R_2$, and $R_3$ and $R_4$, are on adjacent carbon atoms and form a fused benzene ring, any pair not forming a ring being as defined above, $R_5$ is $C_{1-4}$alkyl, unsubstituted or mono-substituted by hydroxy, cyano, phenyl, $C_{2-4}$alkenyl, carboxy, $C_{1-4}$alkoxycarbonyl or —$CONR_6R_7$; or unsubstituted phenyl, $R_6$ and $R_7$, independently, are hydrogen or $C_{1-4}$alkyl, $R_8$ is $C_{1-4}$alkyl, and X is O or S, in free base, acid addition salt or quaternary ammonium salt form, their production and use as optical brightening agents for polyacrylonitrile.

29 Claims, No Drawings

2'-BENZOTHIAZOLYL-AND 2'-BENZOXAZOLYL-2-BENZIMIDAZOLES

The invention relates to benzimidazole derivatives. The invention provides compounds of formula I,

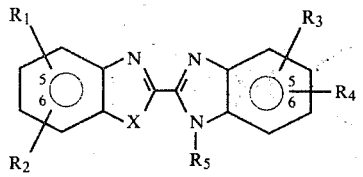

I where either $R_1$, $R_2$, $R_3$ and $R_4$, independently, are hydrogen, $C_{1-4}$alkyl, $C_{1-4}$alkoxy, halogen, cyano, carboxy, alkoxy($C_{1-4}$)carbonyl, —$CONR_6R_7$, —$SO_2NR_6R_7$, —$SO_2R_8$, alkyl($C_{1-4}$)carbonyloxy, or $C_{1-4}$alkoxy monosubstituted by phenyl, alkoxy($C_{1-4}$)carbonyl, cyano, carboxy or —$CONR_6R_7$, with the proviso that a maximum of one of $R_1$ and $R_2$ and a maximum of one of $R_3$ and $R_4$ can signify a group selected from cyano, carboxy, alkyl ($C_{1-4}$)carbonyloxy, —$CONR_6R_7$, —$SO_2NR_6R_7$ and —$SO_2R_8$, or one or both pairs $R_1$ and $R_2$, and $R_3$ and $R_4$, are on adjacent carbon atoms and form a fused benzene ring, any pair not forming a ring being as defined above, $R_5$ is $C_{1-4}$alkyl, unsubstituted or mono-substituted by hydroxy, cyano, phenyl, $C_{2-4}$alkenyl, carboxy, $C_{1-4}$alkoxycarbonyl or —$CONR_6R_7$; or unsubstituted phenyl, $R_6$ and $R_7$, independently, are hydrogen or $C_{1-4}$alkyl, $R_8$ is $C_{1-4}$alkyl, preferably methyl, and X is O or S, which compounds are in free base, acid addition salt or quaternary ammonium salt form.

By "halogen", as used above, is meant chlorine or bromine, chlorine being the preferred halogen.

In the compounds of formula I, $R_1$ and $R_2$ preferably are, independently, hydrogen; $C_{1-4}$alkyl; chlorine; or $C_{1-4}$alkoxy, unsubstituted or mono-substituted by phenyl, alkoxy($C_{1-4}$)carbonyl, carboxy, cyano or —$CONR_6R_7$ or, together, form a fused benzene ring. More preferably one of $R_1$ and $R_2$ is hydrogen or $C_{1-4}$alkyl, the other $C_{1-4}$alkyl; chlorine; or $C_{1-4}$alkoxy, unsubstituted or mono-substituted by phenyl or alkoxy($C_{1-4}$)carbonyl, any alkyl as $R_1$ or $R_2$ preferably being methyl and any unsubstituted alkoxy preferably being $C_{1-2}$alkoxy, more preferably methoxy. Still more preferably, one of $R_1$ and $R_2$ is hydrogen, and most preferably the other is $C_{1-4}$alkoxy, unsubstituted or mono-substituted by phenyl or alkoxy ($C_{1-4}$)carbonyl.

Of $R_3$ and $R_4$, preferably one is hydrogen or $C_{1-4}$alkyl, the other hydrogen, $C_{1-4}$alkyl, chlorine or —$SO_2R_8$, more preferably one being hydrogen, the other being hydrogen or $C_{1-4}$alkyl. Again, any alkyl as $R_3$ or $R_4$ is preferably methyl.

Where the $R_1/R_2$ or $R_3/R_4$ bearing ring is mono substituted, the substituent is preferably in the 5- or 6-position, more preferably in the 6-position, especially for the $R_1/R_2$ bearing ring, and, when di-substituted, one of the substituents is preferably in the 6-position. Preferably the $R_1/R_2$ bearing ring is mono or disubstituted, more preferably mono-substituted.

The preferred forms of the compounds of formula I are the acid addition salt and quaternary ammonium salt forms, particularly the latter. Such forms arise from the basic nature of the heterocyclic nitrogens present both in the benzimidazole and the benzoxazole or benthiazole rings. Whilst it is possible to protonate or quaternise both rings in the compounds of formula I using relatively forcing conditions, it is possible, because of the higher basicity of the benzimidazole ring, to protonate or quaternise this ring alone and, indeed, those acid addition salt and quaternary ammonium salts of the compounds of formula I, wherein only the benzimidazole ring is protonated or quaternized, are preferred.

As examples of quaternising groups may be given $C_{1-4}$alkyl, e.g. methyl, ethyl, isopropyl, n-propyl, n-butyl, $C_{1-4}$alkyl mono-substituted by phenyl, e.g. benzyl, $C_{1-4}$alkyl mono-substituted by $C_{1-2}$alkoxycarbonyl, e.g. —$CH_2CO_2CH_3$ and —$CH_2CO_2C_2H_5$, $C_{1-4}$alkyl mono-substituted by —$CONR_6R_7$, e.g. —$CH_2CONH_2$ and —$CH_2CON(CH_3)_2$, —$CH_2$—CH=$CH_2$, —$CH_2$—C($CH_3$)=$CH_2$, —$CH_2COOH$ and —$CH_2CN$. The anion may be any non-chromophoric anion.

Since the intended use of the compounds is as optical brightening agents, positions of and combinations of substituents which yield compounds having an unduly strong coloured hue should, of course, be avoided.

The preferred compounds of the invention may be represented by the formula I',

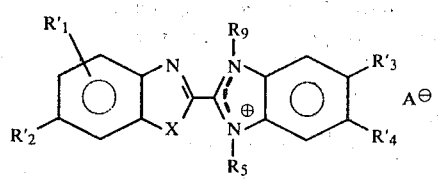

I' where $R_2'$ is $C_{1-4}$alkyl; chlorine; or $C_{1-4}$alkoxy, unsubstituted or mono-substituted by phenyl or alkoxy($C_{1-4}$)carbonyl, and $R_1'$ is H or $C_{1-4}$alkyl, one of $R_3'$ and $R_4'$ is hydrogen or $C_{1-4}$alkyl, (preferably methyl), the other hydrogen, $C_{1-4}$alkyl (preferably methyl), chlorine or —$SO_2CH_3$, preferably one being hydrogen or methyl, the other being hydrogen, $R_9$ is $C_{1-4}$alkyl, unsubstituted or mono-substituted by alkoxy($C_{1-2}$)carbonyl, phenyl or —$CONR_6R_7$, and $A^{\ominus}$ is a non-chromophoric anion.

In compounds I', $R_9$ is preferably unsubstituted $C_{1-4}$alkyl, more preferably methyl or ethyl. $R_5$, both in compounds I and I', is preferably $C_{1-4}$alkyl, unsubstituted or mono-substituted by hydroxy, cyano, phenyl or alkoxy($C_{1-4}$)carbonyl, more preferably $C_{1-4}$alkyl, unsubstituted or mono-substituted by phenyl or alkoxy($C_{1-4}$)carbonyl. In any hydroxy substituted alkyl as $R_5$, the hydroxy group is preferably other than on the $\alpha$-carbon atom, it preferably being on the $\beta$-carbon atom.

$R_2'$ is preferably $C_{1-4}$alkoxy, unsubstituted or mono-substituted by phenyl or alkoxy($C_{1-4}$)carbonyl. $R_1'$ is preferably hydrogen.

X, both in compounds I and I', is preferably O.

As a further preferred class of compounds of formula I may be given those of formula I'',

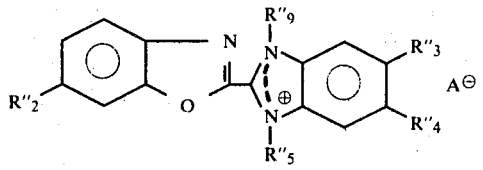

I'' where $R_2''$ is $C_{1-4}$alkoxy, unsubstituted or mono-substituted by phenyl or alkoxy($C_{1-4}$)carbonyl, more preferably methoxy or alkoxy($C_{1-2}$)carbonylmethoxy, most preferably methoxy, one of $R_3''$ and $R_4''$ is hydrogen or methyl, the other being hydrogen, $R_5''$ is $C_{1-4}$, preferably $C_{1-2}$, alkyl, unsubstituted or mono-substituted by phenyl or alkoxy($C_{1-4}$)carbonyl, and $R_9''$ is $C_{1-4}$alkyl, preferably methyl or ethyl, $R_5''$ in formula I'', and indeed $R_5$ in formulae I and I' is most preferably methyl, ethyl, benzyl or alkoxy($C_{1-2}$)carbonyl methyl.

As examples of non-chromophoric anions as $A^{\ominus}$ may be given methyl, ethyl and propyl sulphate anions and the chloride, bromide, p-toluene-sulphonate, chlorozincate and benzene-sulphonate anions. As will be appreciated, however, the anion may be any conventional in the optical brightener art.

The invention also provides a process for the production of compounds of formula I, characterised by (a). reacting a compound of formula II,

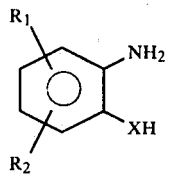

II with a compound of formula III,

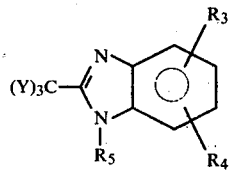

III where Y is chlorine or bromine, preferably chlorine, (b). oxidising a compound of formula V

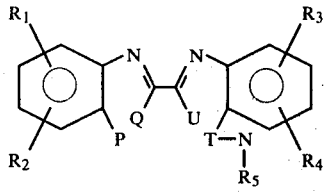

V wherein either (a). P is —XH and Q is H, and U and T form a direct bond between the atoms to which they are attached, or (b). P and Q, together form —X—, and U and T are both hydrogen, in case (a). the compound optionally being in protonized or quaternized form, (c). obtaining a compound of formula I, in which $R_5$ is other then phenyl, by alkylation of a compound of formula IV,

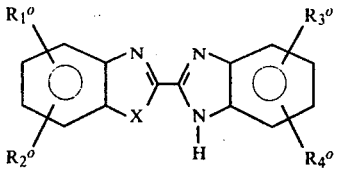

IV in which $R_1^0$, $R_2^0$, $R_3^0$ and $R_4^0$ each have a significance of $R_1$, $R_2$, $R_3$ and $R_4$, above, or one or more thereof signifies hydroxy, the alkylation being carried out with an alkylation agent which yields a $C_{1-4}$alkyl, unsubstituted or mono-substituted by hydroxy, cyano, phenyl, $C_{2-4}$alkenyl, carboxy, alkoxy($C_{1-4}$)carbonyl or —$CONR_6R_7$, alkylating group when $R_1^0$, $R_2^0$, $R_3^0$ and $R_4^0$ have significances of $R_1$, $R_2$, $R_3$ and $R_4$, or with an alkylating agent which yields a $C_{1-4}$alkyl, unsubstituted or mono-substituted by phenyl, alkoxy($C_{1-4}$)carbonyl, cyano, carboxy or —$CONR_6R_7$, alkylating group when one or more of $R_1^0$ to $R_4^0$ is hydroxy, simultaneous alkylation of said hydroxy group taking place in the latter case, and, where desired, converting any compound of formula I, obtained in free base form, into acid addition salt or quaternary ammonium salt form.

Process (a). is suitably carried out in an inert polar solvent, such as in water, ethanol, methanol, isopropanol, cellosolve, dimethylformamide or mixtures thereof. A suitable reaction temperature is −50° to +150° C., preferably 0° to 100° C. The reaction is suitably carried out in the presence of a base such as sodium carbonate, acetate, hydroxide or methoxide, potassium hydroxide, triethylamine or pyridine.

Process (b). is suitably carried out in an inert solvent, e.g. water, ethanol, acetone, acetic acid, dimethylformamide, xylene, chlorobenzene, carbon tetrachloride, chloroform or pyridine. Suitable oxidizing agents include air, manganese dioxide, lead tetraacetate, sodium hypochlorite, nitrobenzene and chloranil. A suitable reaction temperature is from 0° to 200° C., preferably 20° to 150° C.

Process (c). is suitably carried out in an inert solvent, such as chloroform, trichloroethylene, benzene, toluene, chlorobenzene, dioxan, dimethylformamide, methanol, ethanol, propanol, cellusolve or water. The alkylating agent is, of course, dictated by the desired significance of $R_5$ in the resulting compounds formula I, and the desired significance of $R_1$ to $R_4$ when one of $R_1^0$ to $R_4^0$ in compound IV is hydroxy, and is chosen accordingly. As examples of alkylating agents may be given dimethyl and diethyl sulphate, alkyl halides such as methyl, ethyl and propyl iodide and butyl bromide, methyl p-toluenesulphonate, benzyl chloride, ethylene oxide, ethylbromoacetate, allyl chloride, acrylonitrile and acrylamide. The reaction is preferably carried out in the presence of a base, such as sodium, potassium or calcium carbonate or hydroxide, calcium or magnesium oxide, magnesium hydroxide, triethylamine or benzyltrimethylammonium hydroxide. A suitable reaction temperature is from −50° to +200° C., preferably 0° to 100° C. As will be appreciated, during such alkylation, any carboxy group present in the molecule will likely be alkylated. Where such occurs, hydrolysis of the ester group can subsequently be effected.

The conversion of the free base forms of compounds of formula I into acid addition salt or quaternary ammonium salt form may be carried out in conventional manner, employing conventional protonating or quaternising agents. As examples of quaternising agents may be given dimethyl and diethylsulphates, methyl, ethyl and propyl bromides, methyl p-toluenesulphonate, ethylene oxide, benzyl chloride, ethylchloroacetate, allyl bromide, bromo-acetic acid, chloro-acetamide and chloro-N,N-dimethylacetamide. Suitable protonating agents include mineral and organic acids. Suitable solvents for the quaternisation or protonisation include trichloroethylene, toluene, chlorobenzene, dioxan, dimethylformamide, methanol, ethanol and water. A suitable reaction temperature is from 0° to 150° C., preferably 20° to 100° C. Preferably at least one equivalent of protonating or quaternization agent is employed. If desired, and where the quaternating group is the same as $R_5$, the quaternization can be carried out simultaneously with process (c). i.e. alkylation and quaternisation being effected at the same time, employing, for example, an excess of the alkylating agent. In this case, a base, e.g. as set out for process (c)., is preferably employed.

As will be appreciated, interconversions from one compound of formula I to another may be carried out, e.g. by conversion of carboxy or nitrile group(s) into ester and amide group(s), by conversion of nitrile, amide and ester group(s) into carboxy group(s) and interconversion of the anions in the protonated and quaternized compounds.

The resulting compounds of formula I may be isolated and purified in conventional manner.

The compounds of formulae II to V are either known or may be obtained from available starting materials in analogous manner to similar known compounds. For example, the compounds of formula IV are conveniently prepared in analogous manner to compounds I, e.g. in analogy to process (a)., but employing starting materials having hydrogen in place of $R_5$.

The compounds of formula I are optical brightening agents, being especially indicated for use in the brightening of substrates, preferably textile substrates, comprising or consisting of polyacrylonitrile polymers or acrylonitrile copolymers, such co-polymers, for example, consisting of more than 80–95% acrylonitrile copolymerised with 20 to 5% vinyl acetate, vinyl pyridine, vinyl chloride, vinylidene chloride or acrylic acid, acrylic ester, methacrylic acid or methacrylic ester.

The compounds of formula I may be applied in conventional manner to such substrates which may, for example, be in fibre, filament, woven, knitted, non-woven etc. form, e.g. from an aqueous bath, preferably under acid conditions, and in the presence or absence of chlorite bleach. The amount of brightener used, based on the weight of the substrate is generally in the range of from 0.001 to 0.5%, preferably 0.01 to 0.2%. The compounds in protonated or quaternized form, particularly those of formula I', have good water-solubility and have notable stability to bleaching agents such as sodium chlorite and metabisulphite. The brightenings obtained generally have good light fastness properties.

The compound of formula I may also be used in the mass brightening of textile filaments, e.g. by incorporation in spinning melts or solutions.

The following Examples illustrate the invention.

EXAMPLE 1

(process (c))

2-Trichloromethylbenzimidazole (36.6 g) and 2-amino-5-methoxyphenol (24.2 g) were stirred together in 95% ethanol (300 ml). Triethylamine (47.9 g) was added dropwise to the stirred mixture over a period of 15 minutes, keeping the temperature below 30° C. by external cooling. The solution was then stirred at 20°–25° C. for a further 2 hours. Water was then added and the mixture stirred for 30 minutes. The precipitated oil solidified and was filtered off, dried and crystallised from acetone and then n-butanol. 10 g of the resultant fawn coloured solid was mixed with anhydrous potassium carbonate (5.2 g), sodium iodide (5.7 g), benzyl chloride (3.3 g) acetone (50 ml) and dimethylformamide (20 ml) and the mixture stirred and heated under reflux for 4½ hours. The resultant mixture was filtered hot and the filtrate cooled to 0° C. The precipitate was filtered, washed with acetone and dried to give a compound of formula

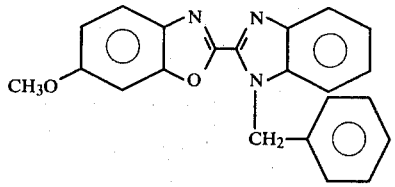

as a fawn coloured solid.

EXAMPLE 2–11

The compounds listed in the following table were prepared by a procedure similar to that described in Example 1 but employing the appropriate starting materials and reagents. They are of formula

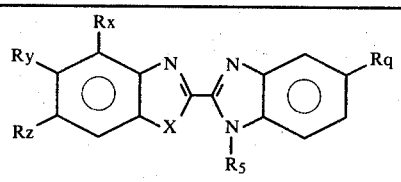

| Example | X | Rx | Ry | Rz | Rq | $R_5$ | Physical appearance |
|---|---|---|---|---|---|---|---|
| 2 | O | H | H | $OCH_3$ | H | $CH_3$ | pale fawn solid |
| 3 | O | H | H | $CH_3$ | H | $CH_2Ph$ | colourless solid |

-continued

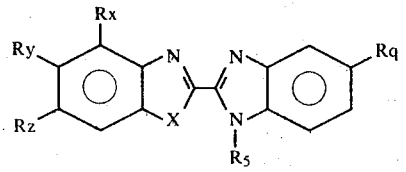

| Example | X | Rx | Ry | Rz | Rq | $R_5$ | Physical appearance |
|---|---|---|---|---|---|---|---|
| 4 | S | H | H | $OCH_3$ | H | $CH_3$ | pale yellow solid |
| 5 | O | $CH_3$ | H | $CH_3$ | H | $CH_2Ph$ | white solid |
| 6 | O | $CH_3$ | H | $CH_3$ | $SO_2CH_3$ | $CH_2Ph$ | white solid |
| 7 | O | H | H | $CH_3$ | $SO_2CH_3$ | $CH_2Ph$ | white solid |
| 8 | O | H | $OCH_3$ | H | H | $CH_3$ | pale yellow solid |
| 9 | O | H | $OCH_3$ | H | H | $CH_2—CH=CH_2$ | white solid |
| 10 | O | H | H | $OCH_3$ | H | $CH_2CO_2Et$ | white solid |
| 11 | O | H | Cl | $OCH_3$ | H | $CH_3$ | white solid |
| 11a | O | $CH_3$ | H | $CH_3$ | H | $CH_2CO_2Et$ | white solid |
| 11b | O | H | H | $OCH_3$ | $CH_3$ | $CH_3$ | white solid |
| 11c | O | H | H | $OCH_3$ | Cl | $CH_3$ | white solid |
| 11d | O | H | H | $OCH_3$ | H | $CH_2CO_2CH_3$ | white solid |
| 11e | O | H | H | OEt | H | $CH_3$ | white solid |

Ph = phenyl
Et = ethyl

EXAMPLE 12

(quaternization)

The compound described in Example 1 (5.4 g) was mixed with dioxan (100 ml) and dimethyl sulphate (1.9 g) and the mixture heated under reflux for 1 hour then cooled to 20° C. and filtered to give a compound of formula

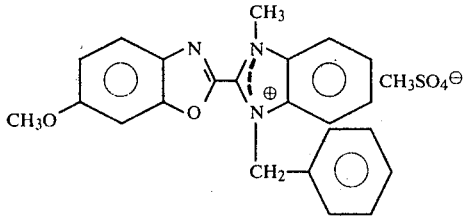

as a pale yellow solid.

EXAMPLE 13

Compounds of the following table were also prepared by a procedure similar to that described in Example 12 but employing appropriate starting materials. They are of formula

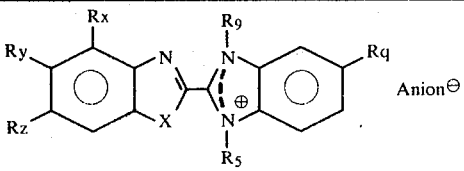

| Ex. | X | Rx | Ry | Rz | Rq | $R_9$ | $R_5$ | Anion$^{\ominus}$ | Physical Appearance |
|---|---|---|---|---|---|---|---|---|---|
| 14 | O | H | H | $CH_3$ | H | $CH_3$ | $CH_2Ph$ | $CH_3SO_4^{\ominus}$ | colourless solid |
| 15 | O | H | H | $OCH_3$ | H | $CH_3$ | $CH_3$ | $CH_3SO_4^{\ominus}$ | pale yellow solid |
| 16 | S | H | H | $OCH_3$ | H | $CH_3$ | $CH_3$ | $CH_3SO_4^{\ominus}$ | yellow solid |
| 17 | O | $CH_3$ | H | $CH_3$ | H | $CH_3$ | $CH_2Ph$ | $Cl^{\ominus}$ | white solid |
| 18 | O | $CH_3$ | H | $CH_3$ | $SO_2CH_3$ | $CH_3$ | $CH_2Ph$ | $CH_3SO_4^{\ominus}$ | white solid |
| 19 | O | H | H | $CH_3$ | $SO_2CH_3$ | $CH_3$ | $CH_2Ph$ | $CH_3SO_4^{\ominus}$ | white solid |
| 20 | O | H | $OCH_3$ | H | H | $CH_3$ | $CH_3$ | $CH_3SO_4^{\ominus}$ | pale yellow solid |
| 21 | O | H | H | $OCH_3$ | H | $CH_3$ | $CH_2CH=CH_2$ | $CH_3SO_4^{\ominus}$ | white solid |
| 22 | O | H | H | $OCH_3$ | H | $CH_3$ | $CH_2CO_2Et$ | $CH_3SO_4^{\ominus}$ | pale yellow solid |
| 23 | O | H | Cl | $OCH_3$ | H | $CH_3$ | $CH_3$ | $CH_3SO_4^{\ominus}$ | pale yellow solid |
| 24 | O | H | H | $OCH_3$ | H | $C_2H_5$ | $CH_2CO_2Et$ | $CH_3SO_4^{\ominus}$ | pale yellow solid |

-continued

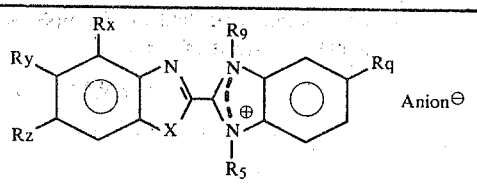

| Ex. | X | Rx | Ry | Rz | Rq | $R_9$ | $R_5$ | Anion⊖ | Physical Appearance |
|---|---|---|---|---|---|---|---|---|---|
| 25 | O | H | H | $OCH_3$ | H | $CH_3$ | $C_2H_4CN$ | $CH_3SO_4$⊖ | pale yellow solid |
| 26 | O | H | H | $OCH_3$ | H | $CH_3$ | $C_2H_4CO_2CH_3$ | ½$ZnCl_4$⊖ | pale yellow solid |
| 26a | O | $CH_3$ | H | $CH_3$ | H | $CH_2CO_2Et$ | $CH_2CO_2Et$ | Br⊖ | pale yellow solid |
| 26b | O | $CH_3$ | H | $CH_3$ | H | $CH_2CO_2Et$ | $CH_2Ph$ | Br⊖ | pale yellow solid |
| 26c | O | $CH_3$ | H | $CH_3$ | $SO_2CH_3$ | $CH_2CO_2Et$ | $CH_2Ph$ | Br⊖ | pale yellow solid |
| 26d | O | H | H | $OCH_3$ | $CH_3$ | $CH_3$ | $CH_3$ | $CH_3SO_4$⊖ | pale yellow solid |
| 26e | O | H | H | $OCH_3$ | Cl | $CH_3$ | $CH_3$ | $CH_3SO_4$⊖ | pale yellow solid |
| 26f | O | H | H | $OCH_3$ | H | $CH_2CO_2CH_3$ | $CH_3$ | $CH_3SO_4$⊖ | pale yellow solid |
| 26g | O | H | H | $OC_2H_5$ | H | $CH_3$ | $CH_3$ | $CH_3SO_4$⊖ | pale yellow solid |

Ph = phenyl
Et = ethyl

EXAMPLE 27

(process (c) with simultaneous quaternisation)

2-Trichloromethylbenzimidazole (23.6 g) and 1-amino-2-hydroxynaphthalene hydrochloride (19.6 g) were stirred together in 2-ethoxyethanol (100 ml) whilst triethylamine (40.4 g) was added dropwise with external cooling to keep the temperature of the reaction mixture below 30° C. The mixture was stirred at ambient temperature for a further 17 hours and poured into water (500 ml). The precipitate was filtered, dried and crystallised from dioxan. 7 g of the resultant fawn coloured solid was stirred in dioxan (30 ml) together with magnesium oxide (0.5 g) and dimethyl sulphate (6.2 g). The mixture was heated to reflux, stirred under reflux for 17 hours, cooled to 20° C. and filtered. Crystallisation of the crude solid product from isopropanol gave a compound of formula

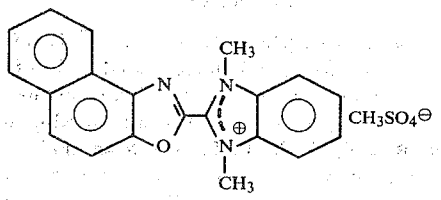

as a yellow coloured solid.

EXAMPLE 28

(Process (c))

6-Hydroxy-2(2')-benzimidazolyl benzoxazole (100 g), ethyl bromoacetate (166.3 g), anhydrous potassium carbonate (55.0 g) and acetone (600 ml) were stirred together under reflux for 3 hours. The solution was then filtered hot to remove inorganic salts and 300 ml of acetone distilled out. The solution was then cooled to 0° C. and the precipitated solid filtered off and dried to give a compound of formula

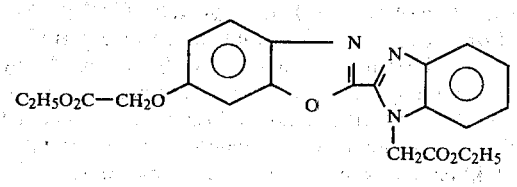

as a white solid. 6-Hydroxy-2(2')-benzimidazolyl benzoxazole was prepared by a procedure similar to that described in Example 1, above, but employing the appropriate starting materials.

EXAMPLE 29

By proceeding as described in Example 28, but employing benzyl chloride in place of ethyl bromoacetate, the compound of formula

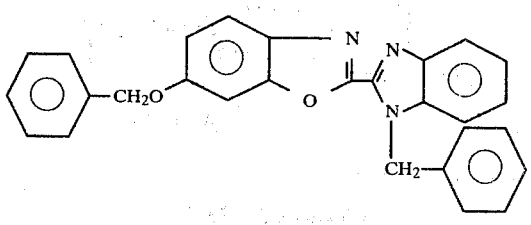

is obtained as a white solid.

EXAMPLE 30

(Quaternisation)

The compound described in Example 28 (4.5 g) was mixed with dioxan (25 ml) and dimethyl sulphate (1.48 g) and the mixture heated under reflux for 2 hours, then cooled to 20° C. and filtered to give the compound of formula

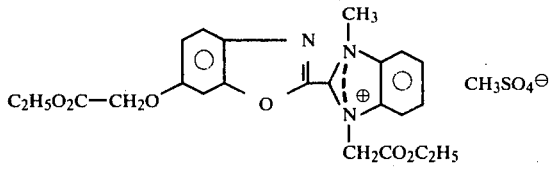

as a white solid.

EXAMPLE 31

Following the procedure described in Example 30, but employing the compound of Example 29 in place of the compound of Example 28, there is obtained the compound of formula

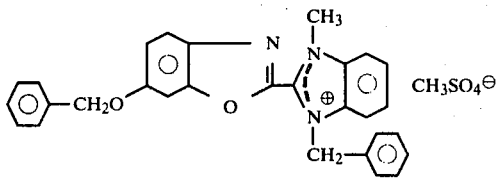

as a pale yellow solid.

EXAMPLE 32

(process (c))

2-Trichloromethylbenzimidazole (36.6 g) and 2-amino-5-methoxy phenol (24.2 g) were stirred together in 95% ethanol (300 ml), triethylamine (47.9 g) was added dropwise to the stirred mixture over a period of 15 minutes, keeping the temperature below 30° C. by external cooling. The solution was then stirred at 20°–25° C. for a further 2 hours. Water was then added and the mixture stirred for 30 minutes. The precipitated oil solidified, and was filtered off and crystallised from acetone and then butanol. 13.05 g of the resultant fawn coloured solid was stirred under reflux in dioxan (50 ml) with acrylonitrile (9 g) and benzyl trimethyl ammonium hydroxide 40% W/W aqueous solution (0.5 ml) for 17 hours. The solution was then cooled to 40° C. and added to 100 cc of water. The precipitated solid was filtered, washed with water and dried to give the compound of formula

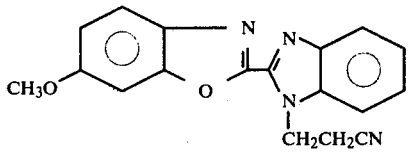

as a fawn coloured solid.

EXAMPLE 33

The compound of formula

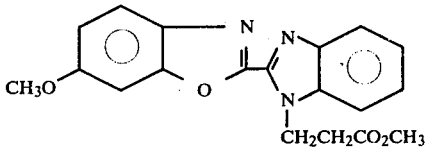

was obtained as a white solid in a similar way to the compound described in Example 32 but using methyl acrylate instead of acrylonitrile.

EXAMPLE 34

The compound of formula

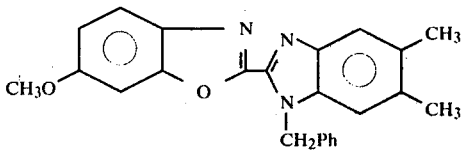

was obtained as a white solid in a similar way to the compound described in Example 1, but using appropriate starting materials and reagents.

EXAMPLE 35

The compound of formula

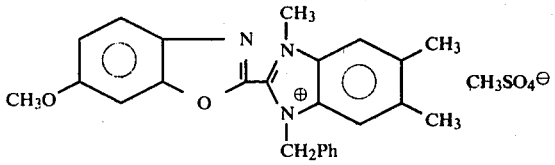

was obtained as a pale yellow solid in a similar way to the compound described in Example 12 but using appropriate starting materials and reagents.

EXAMPLE 36

(process (a))

1-Methyl-2-trichloromethylbenzimidazole (2.5 g) and 2-amino-5-methoxyphenol (1.4 g) were stirred together in 95% ethanol (25 ml) and triethylamine (1 g) added dropwise to the stirred mixture, keeping the temperature below 30° C. by external cooling. The mixture was then heated to the boil and stirred under reflux for 2 hours. The mixture was then cooled to 20° C., filtered and the solid washed with water and dried to give the compound described in Example 2 as a pale fawn solid.

EXAMPLE 37

(protonation)

The compound described in Example 2 (5 g) was stirred in water (25 ml) and concentrated hydrochloric acid (36% w/w) (5 g) was added. The mixture was heated to the boil to give a clear solution and then the solution was cooled to 20° C. The resulting solid precipitate was filtered off and washed with a little 20% w/w hydrochloric acid solution and dried to give the compound of formula

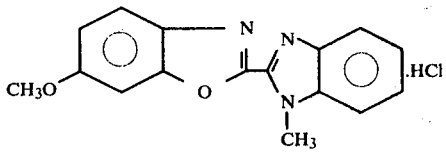

as a pale yellow solid.

EXAMPLE 38

(process (b))

2-Hydroxy-4-methoxy-N-[(1,3-dimethylbenzimidazoliumyl)-2-methylidene]anilinemethosulphate (7.5 g) was stirred in glacial acetic acid (25 ml) and manganese dioxide (2.25 g) added. The mixture was warmed to reflux and stirred under reflux for 30 minutes and then screened to remove excess manganese dioxide. The solution was evaporated, to remove acetic acid and water (20 ml) added. The mixture was warmed until a clear solution was obtained and then the solution cooled to 20° C. and the precipitate filtered, washed with a little water and dried at 80° C. to give the compound described in Example 15 as a pale yellow solid.

The 2-hydroxy-4-methoxy-N-[(1,3-dimethylbenzimidazoliumyl)-2-methylidene]aniline methosulphate used in the above example was prepared as follows:

2-Amino-5-methoxyphenol (50.5 g) was added to isobutanol (200 ml) and 2-dichloromethylbenzimidazole hydrochloride (86 g) and the mixture stirred at 20°–25° C. as triethylamine (110 g) was added dropwise over a period of one hour. The mixture was stirred at 20°–25° C. for sixteen hours, the solid filtered off, washed with isobutanol and then water and dried at 80° C. to give 2-hydroxy-4-methoxy-N-(benzimidazolyl-2-methylidene)-aniline as a pale fawn coloured solid. 2-Hydroxy-4-methoxy-N-(benzimidazolyl-2-methylidene)-aniline (13.4 g) and magnesium oxide (2.0 g) were mixed in 1,2-dichloroethane (50 ml). The mixture was stirred and heated to the boil and dimethyl sulphate (13.9 g) added dropwise to the refluxing mixture over 30 minutes. The mixture was stirred at reflux for a further 2 hours, then cooled to 20° C. and filtered. The solid was washed with 1,2-dichloroethane and dried at 70° C. to give 2-hydroxy-4-methoxy-N[(1,3-dimethylbenzimidazoliumyl)-2-methylidene]-aniline methosulphate as a yellow solid.

APPLICATION EXAMPLES (A). A 5 gram piece of polyacrylonitrile was entered at 40° C. into 200 mls of a solution containing 5 milligrams of the compound described in Example 12 and 100 milligrams of formic acid. The temperature of the bath was raised to 90°–95° C. during 30 minutes then maintained at 90°–95° C. for a further 60 minutes. The fabric was rinsed well in hot then cold demineralized water and dried at 80° C. The treated piece was brilliantly white compared to the untreated fabric. Similar results were obtained when the compound of Example 12 was replaced by the compound of Example 30.

(B). A 5 gram piece of polyacrylonitrile was entered at 40° C. into 200 mls of a solution containing 10 milligrams of the compound described in Example 15, 400 milligrams of sodium chlorite, 400 milligrams of a phosphate based buffer salt and sufficient formic acid to adjust the pH of the bath to 3.5. The temperature of the agitated bath was increased to 90°–95° C. during 30 minutes and maintained at 90°–95° C. for a further 60 minutes. The piece was then anti-chlored for 10 minutes in 200 mls of a solution containing 400 milligrams of sodium metabisulphite, well rinsed with demineralized water and finally dried at 80° C. under tension. The treated piece was brilliantly white compared to the untreated material. Similar results were obtained when the compound of Example 15 was replaced by the compound of Example 31.

What is claimed is:

1. A compound of the formula

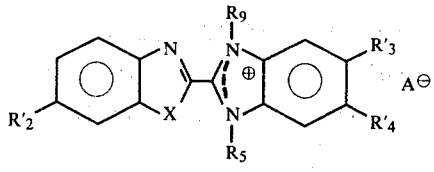

where $R_2'$ is $C_{1-4}$alkyl; chlorine; or $C_{1-4}$alkoxy, unsubstituted or mono-substituted by phenyl or alkoxy($C_{1-4}$)carbonyl, one of $R_3'$ and $R_4'$ is hydrogen and the other is hydrogen, or methyl, $R_5$ is $C_{1-4}$alkyl, unsubstituted or mono-substituted by hydroxy, cyano, phenyl, $C_{2-4}$alkenyl, carboxy, $C_{1-4}$alkoxycarbonyl or —$CONR_6R_7$; or unsubstituted phenyl, $R_6$ and $R_7$, independently, are hydrogen or $C_{1-4}$alkyl, $R_9$ is $C_{1-4}$alkyl, unsubstituted or mono-substituted by alkoxy($C_{1-2}$)carbonyl, phenyl or —$CONR_6R_7$, X is O or S and $A^{\ominus}$ is a non-chromophoric anion.

2. A compound of claim 1, wherein $R_2'$ is $C_{1-4}$alkoxy, unsubstituted or mono-substituted by phenyl or alkoxy($C_{1-4}$)carbonyl.

3. A compound of claim 1, wherein $R_9$ is unsubstituted $C_{1-4}$alkyl.

4. A compound of claim 3, wherein $R_9$ is methyl or ethyl.

5. A compound of claim 1, wherein $R_5$ is $C_{1-4}$alkyl, unsubstituted or mono-substituted by hydroxy, cyano, phenyl or alkoxy($C_{1-4}$)carbonyl.

6. A compound of claim 5, wherein $R_5$ is $C_{1-4}$alkyl, unsubstituted or mono-substituted by phenyl or alkoxy($C_{1-4}$)carbonyl.

7. A compound of claim 6, wherein $R_5$ is methyl, ethyl, benzyl or alkoxy($C_{1-2}$)carbonyl methyl.

8. A compound of claim 1, wherein $R_5$ is $C_{1-4}$alkyl, unsubstituted or mono-substituted by hydroxy, cyano, phenyl or alkoxy($C_{1-4}$)carbonyl.

9. A compound of claim 1, wherein X is O.

10. A compound of claim 1, of formula I''

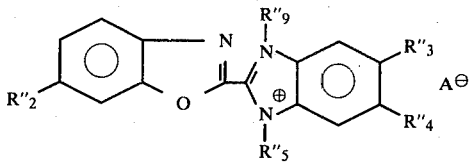

I'' where $R_2''$ is $C_{1-4}$alkoxy, unsubstituted or mono-substituted by phenyl or alkoxy($C_{1-4}$)carbonyl, one of $R_3''$ and $R_4''$ is hydrogen or methyl, the other being hydrogen, $R_5''$ is $C_{1-4}$alkyl, unsubstituted or mono-substituted by phenyl or alkoxy($C_{1-4}$)carbonyl, and $R_9''$ is $C_{1-4}$alkyl.

11. A compound of claim 10, wherein $R_2''$ is methoxy or alkoxy($C_{1-2}$)carbonyl methoxy.

12. A compound of claim 11, wherein $R_2''$ is methoxy.

13. A compound of claim 10, wherein $R_5''$ is $C_{1-2}$alkyl, unsubstituted or mono-substituted by phenyl or alkoxy($C_{1-4}$)-carbonyl.

14. A compound of claim 10, wherein $R_9''$ is methyl or ethyl.

15. A compound of claim 10, wherein $R_5''$ is methyl, ethyl, benzyl or alkoxy($C_{1-2}$)carbonyl methyl.

16. A compound of claim 1, of formula

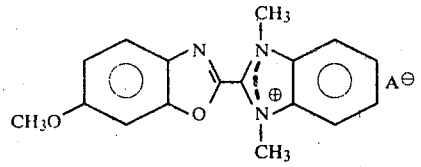

17. A compound of claim 1, of formula

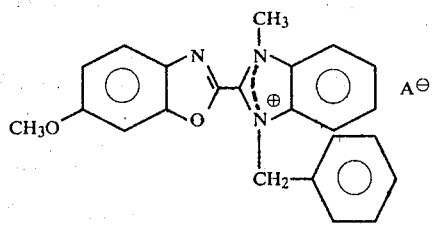

18. A compound of claim 1, of formula

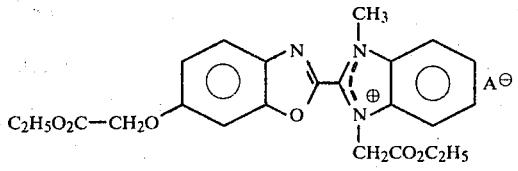

19. A compound of claim 1, of formula

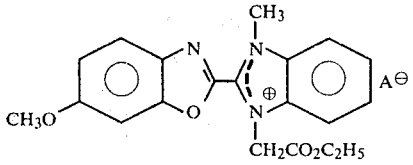

20. A compound of claim 1, of formula

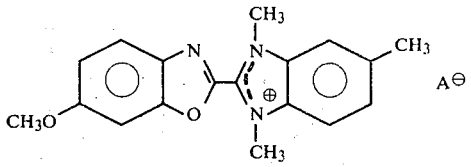

21. A compound of claim 1, wherein $R_2'$ is $C_{1-4}$alkyl, $C_{1-4}$alkoxy or chlorine, one of $R_3'$ and $R_4'$ is hydrogen, the other hydrogen or methyl and $R_9$ is $C_{1-4}$alkyl, unsubstituted or mono-substituted by $C_{1-2}$alkoxy-carbonyl.

22. A compound of claim 21, wherein $R_3'$ and $R_4'$ are both hydrogen.

23. A compound of claim 1, wherein $R_2'$ is $C_{1-4}$alkoxy, mono-substituted by phenyl or by alkoxy($C_{1-4}$)carbonyl, one of $R_3'$ and $R_4'$ is hydrogen, the other hydrogen or methyl and $R_9$ is $C_{1-4}$alkyl, unsubstituted or mono-substituted by $C_{1-2}$alkoxy-carbonyl.

24. A compound of claim 23, wherein $R_3'$ and $R_4'$ are both hydrogen.

25. A compound of claim 23, wherein $R_5$ is $C_{1-4}$alkyl, unsubstituted or mono-substituted by hydroxy, cyano, phenyl or alkoxy($C_{1-4}$)carbonyl.

26. A compound of claim 25, wherein $R_5$ is methyl, ethyl, benzyl or alkoxy($C_{1-4}$)carbonyl methyl.

27. A compound of claim 23, wherein X is O.

28. A compound according to claim 1 wherein $A^{\ominus}$ is the methyl sulphate, ethyl sulphate, propyl sulphate, chloride, bromide, p-toluene sulphonate, chlorozincate or benzene sulphonate anion.

29. A compound according to claim 1 wherein any alkyl as $R_2'$, is methyl.

* * * * *